US005310360A

United States Patent [19]

Peterson

[11] Patent Number: 5,310,360

[45] Date of Patent: May 10, 1994

[54] CIRCUIT BOARD MOUNTED MODULAR PHONE JACK

[75] Inventor: Bruce A. Peterson, Schaumburg, Ill.

[73] Assignee: Molex Incorporated, Lisle, Ill.

[21] Appl. No.: 63,994

[22] Filed: May 18, 1993

[51] Int. Cl.[5] ..... H01R 13/62

[52] U.S. Cl. ..... 439/571; 439/676

[58] Field of Search ..... 439/79, 571, 676

[56] References Cited

U.S. PATENT DOCUMENTS 4,647,136 3/1987 Kinoshita et al. ..... 439/571

4,875,863 10/1989 Reed ..... 439/676 X

*Primary Examiner*—Eugene F. Desmond

*Attorney, Agent, or Firm*—Stephen Z. Weiss

[57] ABSTRACT

An electrical connector assembly is provided for interconnecting a modular phone plug with a printed circuit board. The connector assembly includes a housing having a forward mating end and a rearward end. A plug-receiving socket is formed in the forward mating end and is adapted to receive a modular phone plug. The rearward end is configured so that an edge of a printed circuit board can be inserted at a first angular orientation relative to the housing and then rotated to a second angular orientation. A plurality of terminals are mounted in the housing. Each terminal includes a contact portion at one end, a tail portion at an opposite end and an intermediate portion therebetween. The intermediate portion is anchored in the housing. The contact portion projects into the socket for engaging a contact of the modular phone plug. The tail portion is configured for engaging a contact pad on the printed circuit board with minimal contact force in the first angular orientation of the board and with considerable contact force in the second angular orientation of the board.

9 Claims, 3 Drawing Sheets

CIRCUIT BOARD MOUNTED MODULAR PHONE JACK

FIELD OF THE INVENTION

This invention generally relates to the art of electrical connectors and, particularly, to an electrical connector assembly for interconnecting a modular phone plug with a printed circuit board.

BACKGROUND OF THE INVENTION

Modular phone plugs and receptacles are well known in the telephone industry. The receptacles commonly are called "jacks". A jack includes an insulating housing having a plug-receiving socket. A plurality of terminals are mounted in the housing, the terminals including contact portions or springs extending diagonally rearwardly into the socket for engaging contacts of a modular phone plug.

These modular phone plugs and jacks have been widely adopted as standard components in the telephone industry, and they are being used in ever-increasing applications with equipment other than telephone apparatus. For example, data processing equipment may be installed adjacent a telephone exchange, as well as small computers and similar equipment. The use of modular phone jacks in such related equipment usually requires that the jacks be mounted on printed circuit boards. An example of such an application is shown in U.S. Pat. No. 4,221,458, dated Sep. 9, 1980. In that patent, a modular phone jack is mounted to a printed circuit board by mounting pegs, along with solder tails of the jack terminals inserted into holes in the printed circuit board. These types of applications require considerable mounting forces in the context of the ever-increasing miniaturization of such jacks and their very delicate terminals.

This invention is directed to an improved modular phone jack for interconnecting a modular phone plug to a printed circuit board, with substantially zero interconnecting forces on the jack terminals when the board is initially inserted or coupled to the jack.

SUMMARY OF THE INVENTION

An object, therefore, of the invention is to provide a new and improved electrical connector assembly for interconnecting a modular phone jack with a printed circuit board.

In the exemplary embodiment of the invention, the connector assembly includes housing means having a forward mating end and a rearward end. A plug-receiving socket is formed in the forward mating end and is adapted to receive a modular phone plug. The rearward end of the housing means is configured so that an edge of a printed circuit board can be inserted at a first angular orientation relative to the housing means and then rotated to a second angular orientation.

A plurality of terminals are mounted in the housing means. Each terminal includes a contact portion at one end, a tail portion at an opposite end and an intermediate portion therebetween. The intermediate portion is anchored in the housing means. The contact portion projects into the socket for engaging a contact of the modular phone plug when inserted into the socket. The tail portion is configured for engaging a contact pad on the printed circuit board with minimal contact force in the first angular position of the board and with considerable contact force in the second angular orientation of the board. The contact portions of the terminals extend from the forward end of the housing means diagonally rearwardly into the socket. The tail portions of the terminals extend diagonally across a rear face of the forward end of the housing means.

First latch means are operatively associated between the housing means and the printed circuit board for securing the board against rotation from the second angular orientation. Second latch means are operatively associated between the housing means and the printed circuit board for securing the board against pulling away from the housing means when in the second angular orientation. In the preferred embodiment of the invention, the housing means, including both the first and second latch means, are integrally molded of dielectric material such as plastic.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 3:
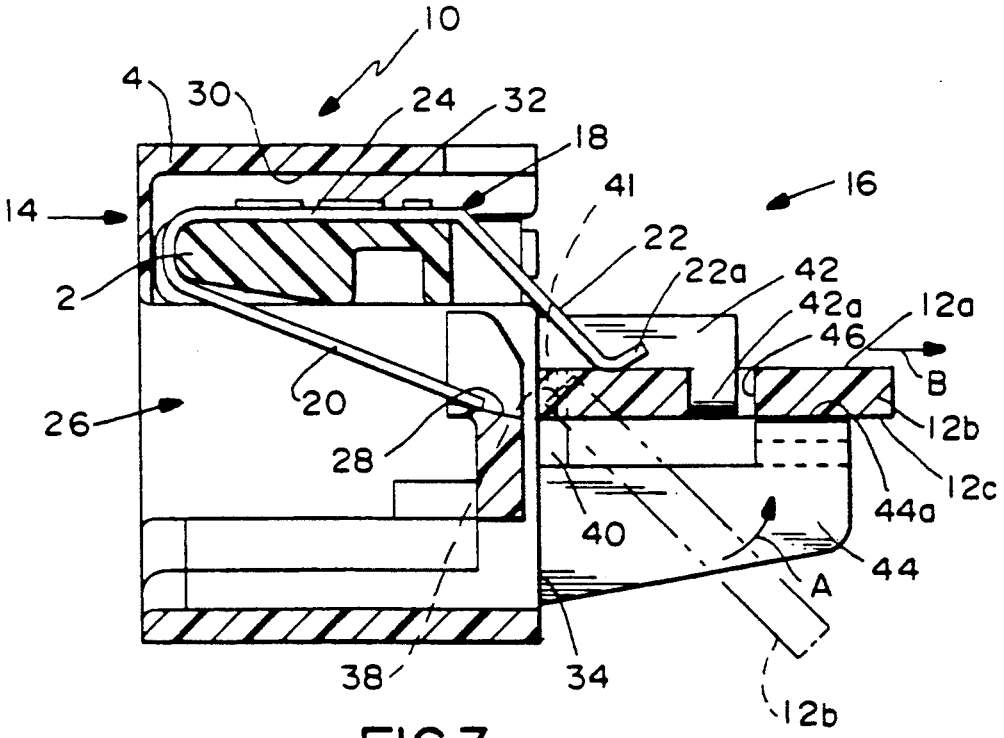
FIG. 3 is a vertical section taken generally along line 3—3 of FIG. 1, with an edge portion of a printed circuit board shown in full lines section fully interconnected to the assembly, the printed circuit board is also shown in phantom in an insertion orientation.
Figure 5:
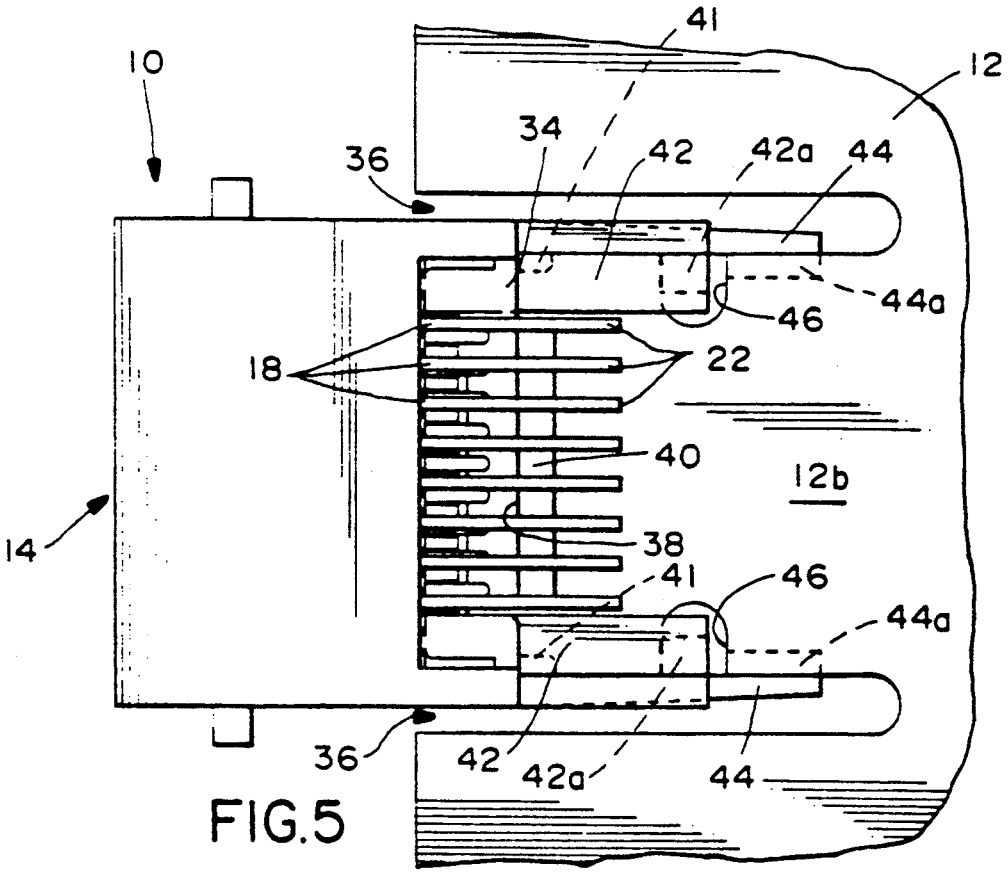
FIG. 5 is a top plan view of the assembly mounted at an edge of the circuit board.

Referring to the drawings in greater detail, the invention is embodied in an electrical connector assembly, generally designated 10, for interconnecting a modular phone plug (not shown) with a printed circuit board 12 (FIGS. 3 and 5). The connector assembly includes a two-piece housing means molded of dielectric material such as plastic or the like, to define a forward mating end, generally designated 14, and a rearward end, generally designated 16. The housing includes inner portion 2 which locks into outer portion 4. Locating rib 5 on each side of the inner housing portion 2 slips into the locating slots 6 in the outer housing portion 4. Once fully inserted, latch 7 on each side of the inner portion 4 locks into locking apertures 8 in the outer portion 4 thereby preventing the removal of inner housing portion 2 from the outer housing portion 4.

A plurality of terminals, generally designated 18, are mounted in the inner housing portion 2. Each terminal includes a contact portion 20 at one end, a tail portion 22 at an opposite end and an intermediate portion 24 therebetween. The tail portion terminates in a distal end **22*a* defining a contact tab for engaging an appropriate circuit trace on a top surface 12***a* of printed circuit board 12.

More particularly, forward mating end 14 of the connector assembly housing 10 defines a plug-receiving socket, generally designated 26, for receiving a conventional modular phone plug. Contact portions 20 of terminals 18 extend from the forward end of the housing diagonally rearwardly into socket 26 as best seen in FIG. 3. The contact portions are pre-loaded, with distal ends thereof seated against an interior surface 28 of the outer housing 4, whereby the contact portions define spring contacts engageable with appropriate contacts of the modular phone jack, as is well known in the art. The intermediate portions 24 are anchored within cavity means 30 by projections 32, and tail portions 22 of the terminals extend diagonally across a rear face 34 of rearward end 16 of the housing, again as best seen in FIG. 3.

Before proceeding with a description of rearward end 16 of the connector assembly, reference is made to FIG. 5 wherein it can be seen that connector assembly 10 actually is edge mounted to a tongue portion 12*b* of printed circuit board 12. The tongue portion is defined by a pair of slots 36 cut into the board. An edge 38 of tongue portion 12*b* of the circuit board actually is the edge of the board to which the connector assembly is mounted.

Figure 4:
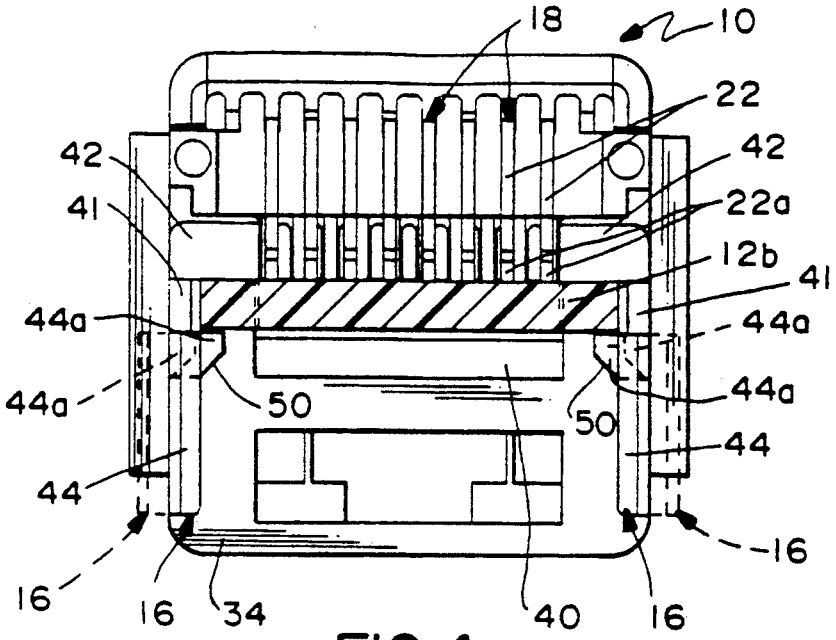
FIG. 4 is a rear elevational view of the assembly, along with the portion of the circuit board.

With the above understanding, edge 38 of the printed circuit board (i.e. the edge of tongue portion 12*b*) is inserted into connector assembly 10 at a first angular orientation as shown in phantom in FIG. 3. The board then is rotated to a second angular orientation as shown in full lines in FIGS. 3–5 whereupon contact tabs 22*a* of tail portions 22 of terminals 18 engage appropriate circuit traces on surface 12*a* of the circuit board. In its first angular orientation, the board is inserted into the connector assembly with minimal contact forces. In fact, in the preferred embodiment, it can be understood that the contact forces in the first angular orientation are zero. When the board is rotated to its second angular orientation as shown by full lines particularly in FIG. 3, substantial contact forces are established in a direction normal to the circuit board between contact tabs 22*a* and the circuit traces on top surface 12*a* of the board.

Figure 1:
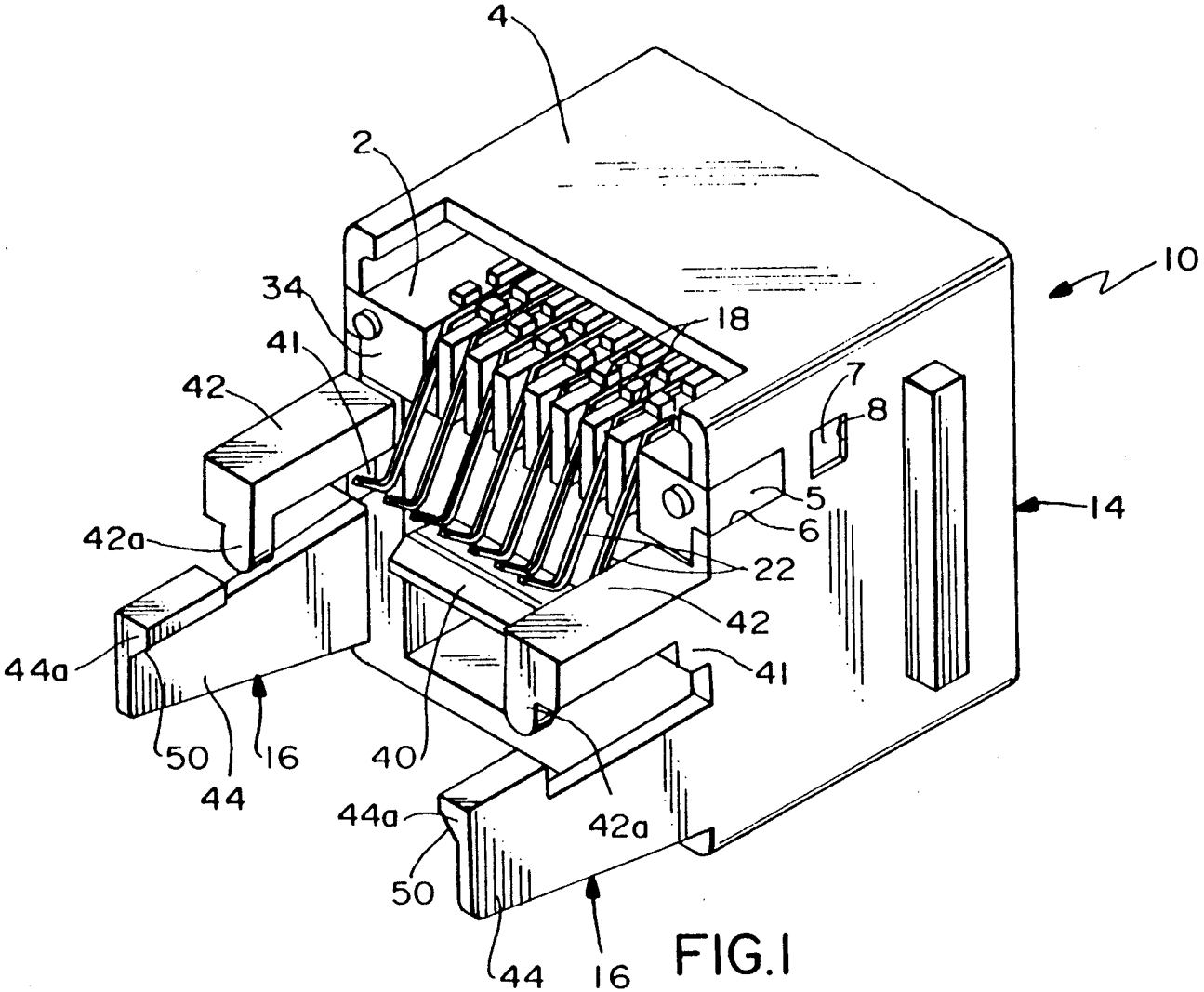
FIG. 1 is a perspective view of an electrical connector assembly embodying the concepts of the invention.
Figure 2:
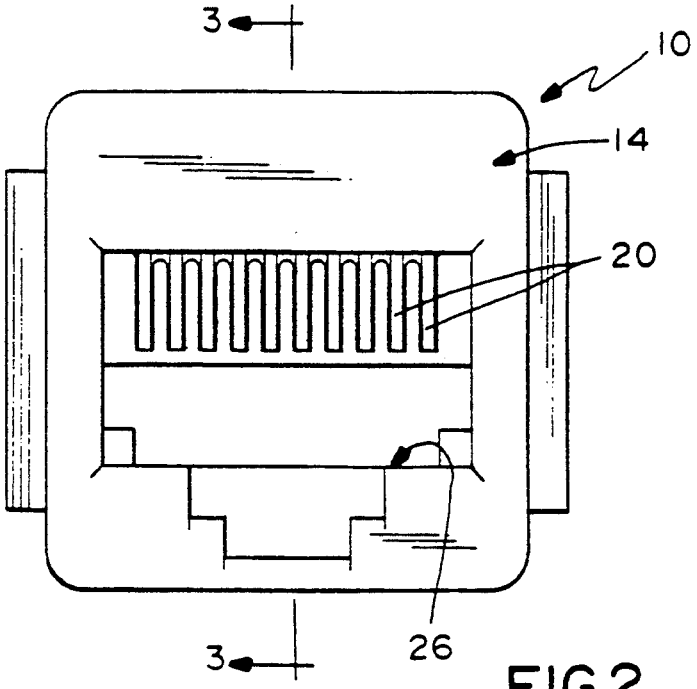
FIG. 2 is a front elevational view of the assembly.

In order to effect the above-described operation and functional characteristics of connector assembly 1, rearward end 16 of the connector assembly includes a laterally extending fulcrum boss 40, a pair of laterally spaced locating bosses 41, a pair of laterally spaced positioning and locking arms 42, and a pair of laterally spaced latch arms 44 all projecting rearwardly of rear face 34. Positioning and locking arms 42 are rigid components and include latch bosses 42*a* which project into holes 46 of the circuit board when the board is in its second angular orientation. Latch arms 44 are flexible components and include inwardly directed latch bosses 44*a* which are seen best in FIGS. 1 and 4 and which engage a bottom side 12*c* of the circuit board when the board is in its second angular orientation. As will be fully understood below, latch bosses 44*a* provide first latch means operatively associated between the housing means and the printed circuit board for securing the board against rotation out of its second angular orientation. Latch bosses 42*a* define a second latch means operatively associated between the housing means and the printed circuit board for securing the board against pulling away from the housing means when in the second angular orientation.

The operation or mounting procedure for mounting connector assembly 10 to printed circuit board 12 (i.e. tongue portion 12*b* of the board) now will be described. The circuit board is inserted into a mouth defined between fulcrum boss 40 and lateral locating bosses 4I and positioning and locking arms 42, at a first angular orientation or insertion direction as shown in phantom in FIG. 3. In this angular orientation, the board can be inserted with substantially zero insertion forces on contact tabs 22*a* of the terminals. The board then is rotated in the direction of arrow "A" (FIG. 3) to a second angular orientation shown in full lines in the drawings. When so rotated, the board will engage chamfered surfaces 50 (FIGS. 1 and 4) of latch bosses 44*a* and bias flexible latch arms 44 outwardly until the board bypasses latch bosses 44*a*, whereupon the latch arms will resiliently snap back into a latching position as shown in the drawings to secure the circuit board against rotation from its second angular orientation. In other words, latch bosses 44*a* of flexible latch arms 44 define the fully interconnected angular position of the circuit board. When rotated to its second angular orientation, latch bosses 42*a* of positioning and locking arms 42 move into holes 46 in the circuit board as best seen in FIG. 3. Rigid latch bosses 42*a* prevent the circuit board from pulling away from the housing in the direction of arrow "B" (FIG. 3). As the board rotates from its first angular orientation to its second angular orientation, bosses 40 act as a fulcrum to facilitate such rotation.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector assembly for interconnecting a modular phone plug with a printed circuit board, comprising:

housing means having a forward mating end and a rearward end, a plug-receiving socket formed in the forward mating end and adapted to receive a modular phone plug, and the rearward end being configured so that an edge of a printed circuit board can be fully inserted with the printed circuit board at a first angular orientation relative to the housing means and then rotated to a second angular orientation; and a plurality of terminals mounted in the housing means, each terminal including a contact portion at one end, a tail portion at an opposite end and an intermediate portion therebetween, the intermediate portion being anchored in the housing means, the contact portion projecting into the socket for engaging a contact of the modular phone plug when inserted into the socket, and the tail portion being configured for engaging a contact pad on the printed circuit board with minimal contact force in said first angular orientation of the board and with considerable contact force in said second angular orientation of the board.

2. An electrical connector assembly as set forth in claim 1 wherein said contact portions of the terminals extend from the forward end of the housing means diagonally rearwardly into the socket.

3. An electrical connector assembly as set forth in claim 1 wherein said tail portions of the terminals extend diagonally across a rear face of the forward end of the housing means.

4. An electrical connector assembly as set forth in claim 1, including latch means operatively associated between the housing means and the printed circuit board for securing the board against rotation from said second angular orientation.

5. An electrical connector assembly as set forth in claim 4, including second latch means operatively associated between the housing means and the printed circuit board for securing the board against pulling away from the housing means when in said second angular or,ientation.

6. An electrical connector assembly as set forth in claim 5 wherein said housing means, including both said latch means, are integrally molded of dielectric material.

7. An electrical connector assembly as set forth in claim 1, including latch means operatively associated between the housing means and the printed circuit board for securing the board against pulling away from the housing means when in said second angular orientation.

8. An electrical connector assembly as set forth in claim 7 wherein said housing means, including said latch means, are integrally molded of dielectric material.

9. An electrical connector assembly for interconnecting a modular phone plug with a printed circuit board, comprising:

a one-piece dielectric housing having a forward end and a rearward end, a plug-receiving socket formed in the forward mating end and adapted to receive a modular phone plug, and the rearward end being configured so that an edge of a printed circuit board can be fully inserted with the printed circuit board at a first angular orientation relative to the housing and then rotated to a second angular orientation;

a plurality of terminals mounted in the housing, each terminal including a contact portion at one end, a tail portion at an opposite end and an intermediate portion therebetween, the intermediate portion being anchored in the housing, the contact portion extending diagonally rearwardly into the socket for engaging a contact of the modular phone plug when inserted into the socket, and the tail portion extending diagonally across a rear face of the forward end of the housing for engaging a contact pad on (the printed circuit board with minimal contact force in said first angular orientation of the board and with considerable contact force in said second angular orientation of the board;

first latch means integral with the housing and operatively associated between the housing and the printed circuit board for securing the board against rotation from said second angular orientation; and second latch means integral with the housing and operatively associated between the housing and the printed circuit board for securing the board against pulling away from the housing when in said second angular orientation.

* * * * *